United States Patent [19]

Fabiano et al.

[11] Patent Number: 4,950,126

[45] Date of Patent: Aug. 21, 1990

[54] MOVIE EQUIPMENT DOLLY

[75] Inventors: Michael J. Fabiano, Carmel, N.Y.; Wes Gilbert, New Tripoli, Pa.; Jeffrey S. Janover, Middletown, N.J.; Robert Ward, Brooklyn, N.Y.

[73] Assignee: Kestrel International, Ltd., Carmel, N.Y.

[21] Appl. No.: 177,588

[22] Filed: Apr. 5, 1988

[51] Int. Cl.[5] ..... B66F 11/00

[52] U.S. Cl. ..... 414/590; 280/47.11; 280/91; 248/184

[58] Field of Search ..... 248/180, 184, 291; 414/589, 590, 349, 426, 921; 180/78, 19.2, 333; 280/47.11, 91

[56] References Cited

U.S. PATENT DOCUMENTS

| | | | |
|---|---|---|---|
| 197,369 | 11/1877 | Hoffman | 248/180 |
| 2,715,534 | 8/1955 | Hoge et al. | 280/91 X |
| 2,995,380 | 8/1961 | King | 280/91 |
| 3,018,116 | 1/1962 | Summers et al. | 280/91 |
| 3,018,992 | 1/1962 | Lore | 248/180 |
| 3,168,284 | 2/1965 | Fisher | 254/93 R X |
| 3,281,118 | 10/1966 | Krilanovich | 414/590 X |
| 4,244,547 | 1/1981 | Kooi | 248/180 |
| 4,482,118 | 11/1984 | Hoffmann | 248/180 |

*Primary Examiner*—Robert J. Spar
*Assistant Examiner*—James T. Eller
*Attorney, Agent, or Firm*—Cooper & Dunham

[57] ABSTRACT

The present invention relates to a movie equipment dolly with a chassis, a lifting arm coupled to the chassis, a hydraulic system for lifting the arm, a plurality of steerable wheels, a transmission for orienting the wheels into selected steering modes, a steering system, slip idlers for selectively disconnecting the wheels from the steering system and transmission, and a control handle that has steering, hydraulic system actuation and transmission steering mode selection operations on a common handle, so that the operator need not remove his or her hands from the control handle when performing any of the operations. The movie dolly also has a levelling head coupled to the lifting arm which allows simple, simultaneous orientation of the levelling head roll and pitch axes by manipulating a pair of adjusters.

7 Claims, 12 Drawing Sheets

MOVIE EQUIPMENT DOLLY

BACKGROUND OF THE INVENTION

This invention relates to movie equipment dollies for transporting movie or television filming apparatus, such as cameras, during filming.

Movie dollies are moveable hoist apparatus that are used in the film industry to support and move cameras and other equipment during film sequences. Known designs of dollies have lift arms, often hydraulically controlled, for adjusting camera elevation, a camera head assembly attached to the end of the lift arm for adjusting the pitch and roll orientation of a camera affixed to the arm and preferably four steerable wheels for translation of the dolly, when a film crew wants to move the camera during film sequences. Three types of dolly steering modes have been traditionally desired in the film industry and they are shown in FIGS. 1–3:

FIG. 1 shows the so-called crab steering mode, wherein the rolling or steering axes of the four steerable wheels are oriented in parallel. In the crab steering mode, the dolly moves generally laterally, as shown by the arrow in FIG. 1, the degree of lateral movement being controlled by the steering handle.

FIG. 2 shows the so-called circular steering mode, wherein the rolling or steering axes of the four steerable wheels are oriented to intersect at a common point, which establishes a circular turning radius. In the circular steering mode, the dolly translates in a circle, as indicated by the arrow in FIG. 2, with the diameter of the steering circle being controlled by the steering handle.

FIG. 3 shows the neutral steering mode, wherein the rolling axes of all four wheels are independently orientable and they are not steered by the steering handle. Rather, the wheels ride on a set of pre-laid tracks, similar to railroad tracks. In the neutral steering mode, the dolly wheels must be disengaged from the steering mechanism.

Previous dolly designs have accomplished all three desired steering modes by use of a transmission coupled to the steering mechanism and the steerable wheels, having selectable crab or circular steering modes, and means to disengage the steerable wheels from the steering system for the neutral mode. Known designs of movie dollies are described in U.S. Pat. Nos. 2,950,121; 3,022,901; 3,168,284; 4,109,678; 4,257,619; and 4,360,187.

Unfortunately, known movie dollies suffer from shortcomings that hamper efficient use by film crew personnel. Known camera levelling heads utilize three or more adjustment screw to orient pitch and roll of the movie camera relative to the lift arm, to level the camera. With three or more adjusting screws, a cameraman can not simultaneously adjust camera pitch and roll, which delays adjustment—a critical flaw during fast-moving action film sequences. Known levelling head designs are bulky, which increases dolly weight and height. Levelling head height restricts how low a camera can be oriented to the ground. Very low film shots cannot be attained with known levelling heads, unless they are attached to the lifting arm with an offset bracket.

Known movie dolly transmissions are bulky, heavy and have complicated designs encompassing inordinate numbers of moving parts that complicate transmission maintenance. It is desirable to manufacture lighter weight movie dollies than previous designs, to reduce the labor required to lift dollies, for example, from transport vehicles to outdoor filming locations. One effective way to reduce dolly weight is to decrease transmission weight and bulk. When shifting known dollies into or out of neutral steering mode, the film crew must perform one of two procedures. In one known design, a separate clutch mechanism, located on each wheel, must be disengaged in order to select the neutral steering mode and to get out of the neutral mode, each wheel must be separately indexed for reconnection to the steering system by manually aligning index marks on each wheel assembly and re-engaging the clutch mechanism. In a second known design, a pin is removed from each wheel assembly to select neutral steering, but to get out of the neutral mode, each wheel must be separately indexed for pin alignment before reinserting the pins. Both known designs require time-consuming manual realignment of the dolly wheels, in order to disengage the neutral steering mode.

Another shortcoming in known movie dolly construction is poor operator ergonomics. Steering, hydraulic lift actuation and transmission steering mode shifting on known dollies are performed on at least two separate control handles or are not accessible without removing at least one hand from the steering handle. The dolly operator normally prefers to keep both of his or her hands on the steering handle and if a rapid vertical camera height adjustment is needed while steering, the operator cannot maintain both hands on the steering handle. Rapid action sequences in many of today's popular films require maximum dolly operator efficiency.

SUMMARY OF THE INVENTION

It is an object of the present invention to solve the shortcomings inherent in known movie dolly designs. Specifically, it is an object of the present invention to develop a movie equipment dolly levelling head having rapid, simultaneous roll and pitch adjustment capabilities, lightweight construction, and low vertical height, to allow the lowest possible angle film shots.

It is another object of the present invention to develop a compact, lightweight transmission that has multiple selectable steering modes with the fewest number of moving parts for ease of maintenance and service.

It is a further object of the present invention to develop a movie dolly with steerable wheels that can shift to or out of the neutral steering mode without the necessity of manually aligning components.

It is additional object of the present invention to develop an ergonomically efficient control handle that combines dolly steering, transmission steering mode selection and lifting arm height adjustment in a single control handle, so that the operator's hands can remain in one position. As part of this object, it is desirable to have each control function actuated by a different kind of gross hand movement, so that the operator is always cognizant of what type of control function he is performing.

Further, it is an object of the present invention to develop a movie dolly that can accomplish any one or more of the foregoing objects.

The foregoing objects are attained by the movie equipment dolly of the present invention, which is described and claimed in greater detail including reference to the drawings which form a part of this specification.

The movie equipment dolly of the present invention features a chassis; a lifting arm connected to the chassis; and a levelling head connected to the lifting arm, having a platform for mounting of a camera device thereon, and means for simultaneously orienting pitch and roll axes of the levelling head, connected to the platform and the lifting arm.

In certain embodiments, the movie equipment dolly of the present invention also features a chassis; at least two steerable wheels connected to the chassis for moving the dolly; means for the steering the steerable wheels; and a transmission for orienting the wheels into selectable steering modes connected to the chassis, having a selectively rotatable transmission shaft connected to the means for steering, a first transmission pulley connected to the shaft, and connected to a first one of the steerable wheels, a second transmission pulley connected to the shaft, and to a second one of the steerable wheels, and means for selectively varying the relative rotation of the first and second pulleys, so that the first and second wheels are separately oriented along selected relative steering axes by the means for steering.

The movie equipment dolly of the present invention also features a chassis; a plurality of steerable wheels connected to the chassis for moving the dolly; means for steering the wheels; and a plurality of slip idlers connected to the wheels and the chassis, having means for selectively connecting and disconnecting the slip idlers from the means for steering and means for simultaneously connecting and disconnecting in unison at least two of the slip idlers.

Lastly, the present invention also features a movie equipment dolly having a chassis; a lifting arm connected to the chassis; means for lifting the lifting arm upon actuation thereof and connected to the lifting arm; at least one steerable wheel connected to the chassis for moving the dolly; a transmission connected to the wheel for orienting the wheel into selectable steering modes upon actuation thereof; and a control handle having a rotatable steering shaft connected to the wheel for steering the wheel, at least one moveable grip portion connected to the steering shaft and the transmission for rotating the shaft and for actuating the transmission and a lever means connected to the steering shaft and the lifting means, for actuating the lifting means.

Any one or more of the features of the movie equipment dolly of the present invention may be combined.

DETAILED DESCRIPTION OF THE PREFERRED EMBODIMENTS

Figure 1:
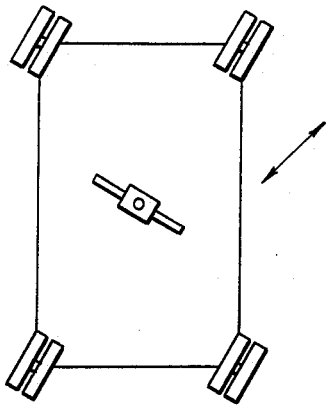
FIG. 1 shows schematically a movie dolly in the crab steering mode.
Figure 3:
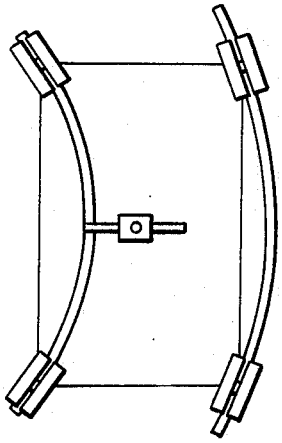
FIG. 3 shows schematically a movie dolly in the neutral steering mode, mounted on a set of tracks.

A better understanding of the present invention may be achieved by reference to the drawing figures which are part of this specification.

Figure 4:
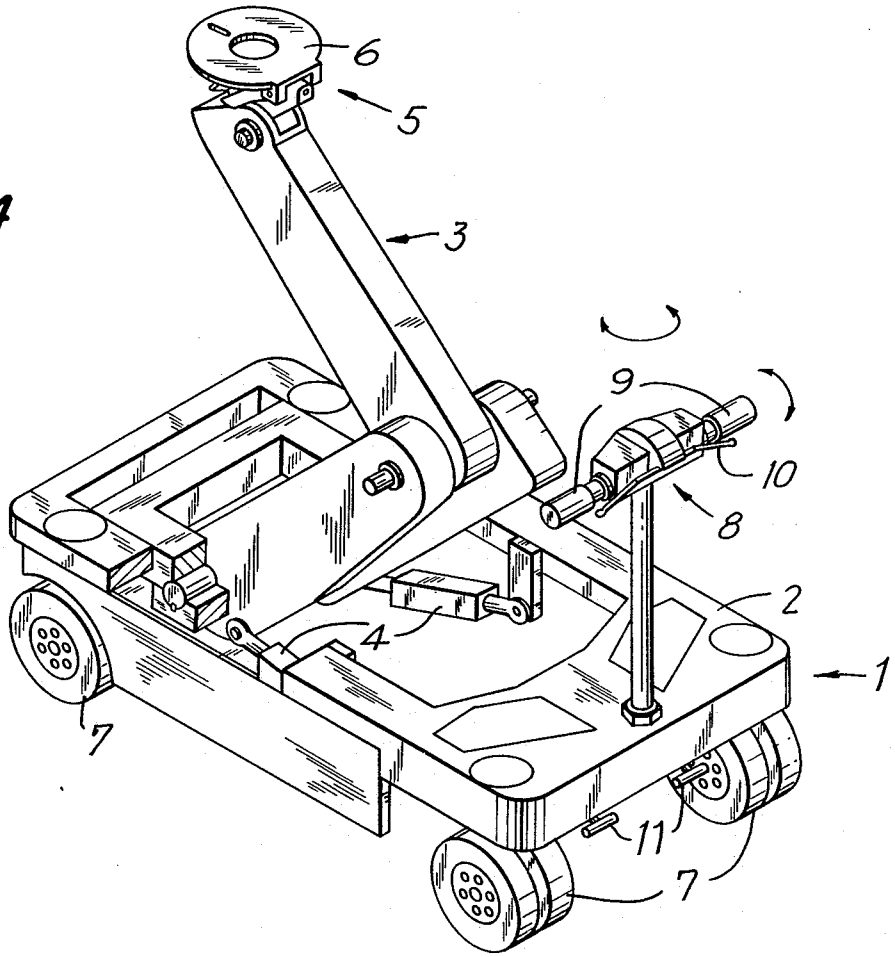
FIG. 4 is a front perspective view of the movie equipment dolly of the present invention, with the lifting arm in a selected intermediate vertical position.
Figure 5:
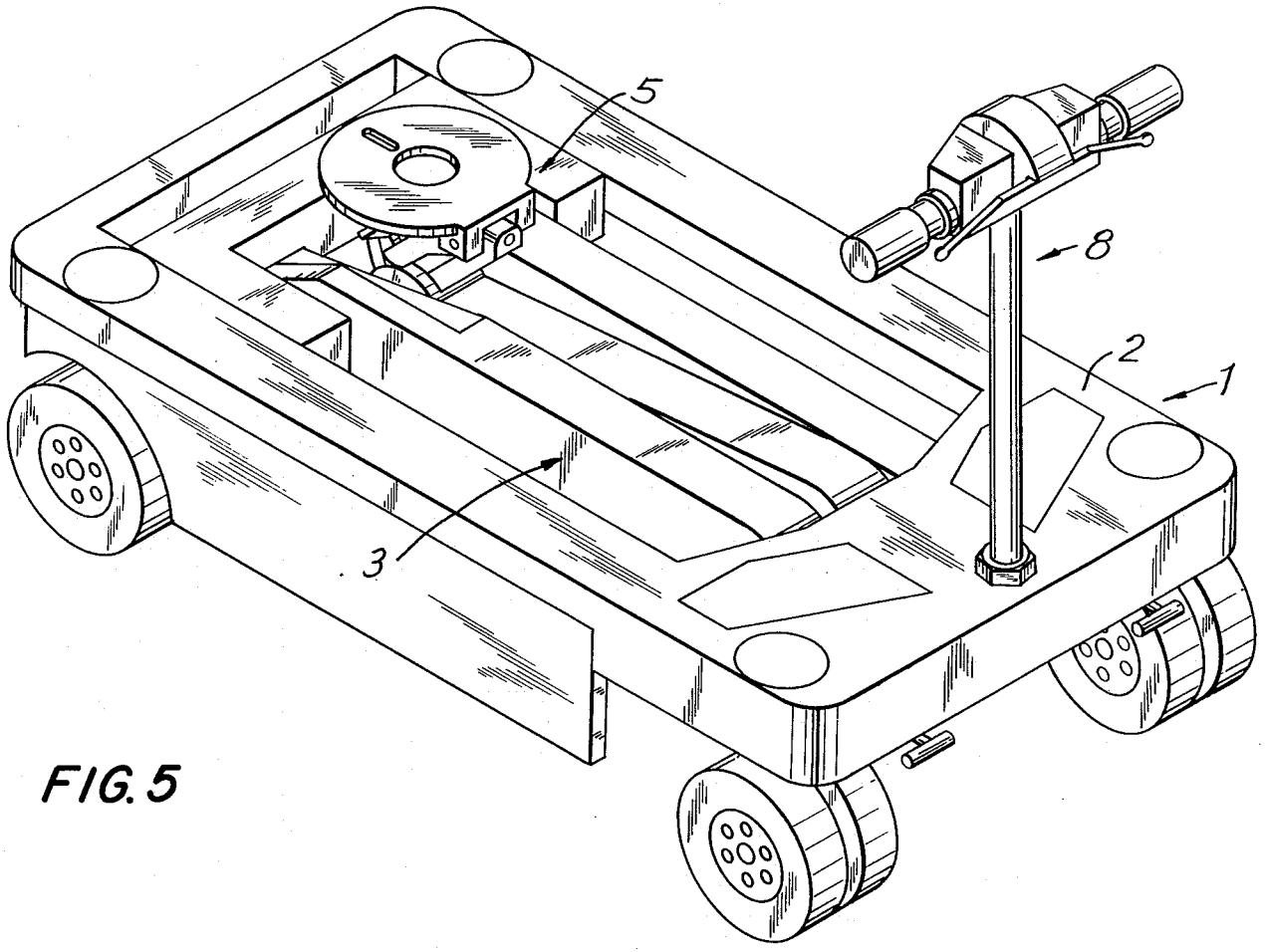
FIG. 5 is a front perspective view similar to FIG. 4, but showing the lifting arm in its lowermost position.

FIGS. 4 and 5 show generally a movie equipment dolly 1 constructed in accordance with the teachings of the present invention, having a chassis 2, and a lifting arm 3 coupled to the chassis and hydraulically actuated by hydraulic cylinders 4. A levelling head 5 is coupled to the lifting arm 3 and has a platform 6 for mounting of a movie equipment device thereon, such as a motion picture camera.

The movie dolly 1 has four steerable wheels 7, three of which are visible, and a control handle 8 for steering the wheels by rotating the handle 8, as shown. Alternatively, the equipment dolly may have three wheels. The control handle 8 can be used to select the crab or circular steering modes by twisting grip portion 9. Lifting arm 3 hydraulic system actuation is performed by rocking control lever 10 up to raise the arm and down to lower the arm. The neutral steering mode is selected by upwardly reciprocating the slip idler gear actuating levers II.

Figure 6:
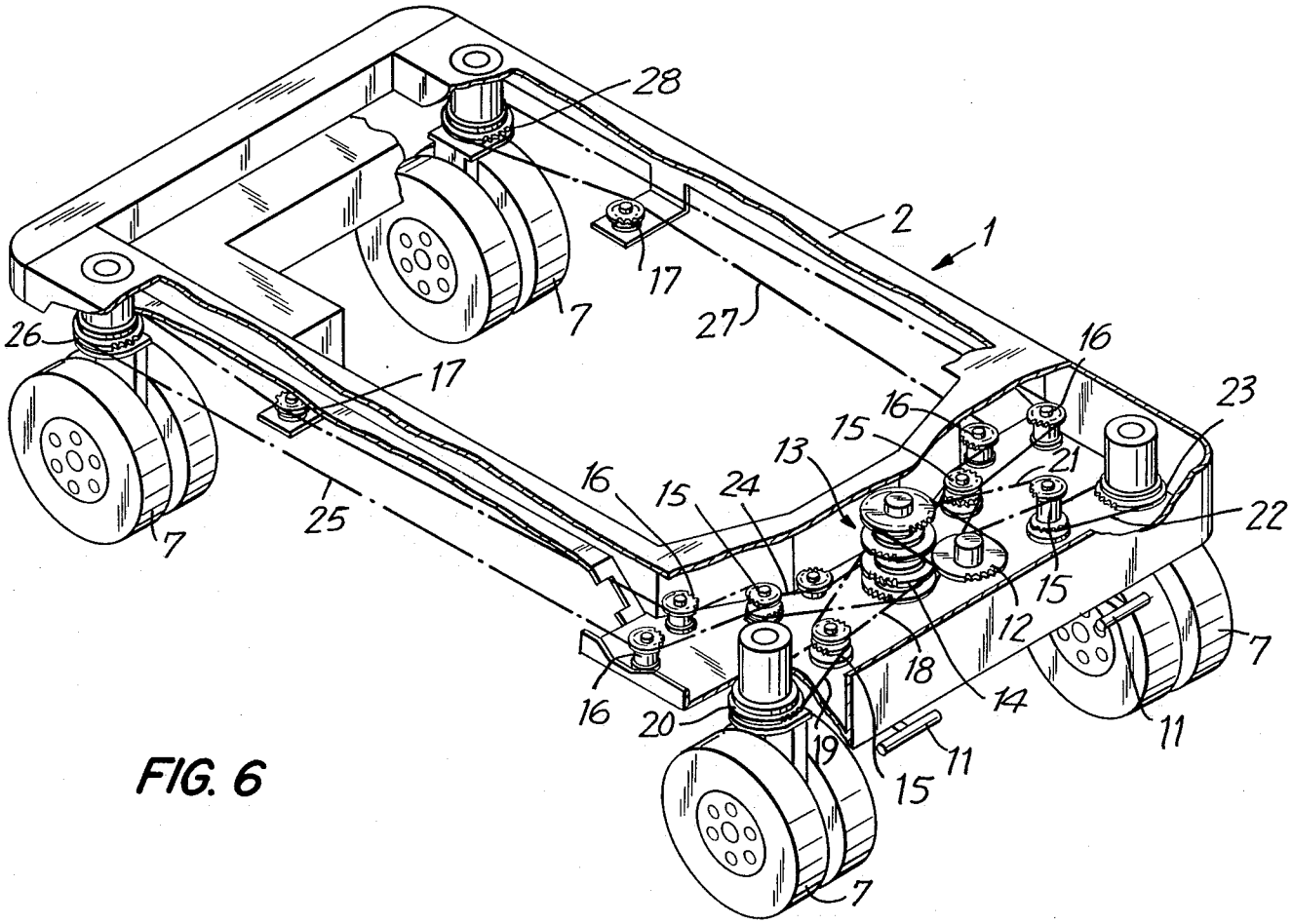
FIG. 6 is a front, partial cutaway, perspective view of the dolly chassis of the present invention, showing the transmission and steering systems.

FIG. 6 shows the means for coupling the steerable wheels 7 to the steering mechanism. To that end, a steering sprocket 12 is connected to a transmission 13 by drive chain 14. The control handle 8, shown in FIG. 4, is coupled to the steering sprocket 12 and is indicated by the shaft stub projecting upwardly from the steering sprocket.

The wheels 7 preferably are steered by chain drive means that couple them to the transmission 13 and in turn to the steering sprocket 12. More specifically, each wheel has a drive chain, connected to the transmission 13 and a slip idler 15; the slip idler and a corresponding wheel sprocket for the driven wheel are in turn connected by a driven chain. By placing a slip idler 15 between the drive and driven chains, a user can selectively disengage the slip idler so that the wheels 7 are no longer controlled by the control handle 8 when the neutral steering mode is desired. Normal idler sprockets 16 (not slip idlers) and chain tensioners 17 can be installed as needed to route chains in the chassis 1 and eliminate chain slack. The chain courses run as follows: The right front drive chain 18 for the right front wheel is coupled to the transmission 13 and slip idler 15 and right front driven chain 19 is coupled to the slip idler and to right front sprocket 20. The left front wheel is coupled to the transmission 13 by left front drive chain 21 which is routed to slip idler 15 and the left front driven chain 22 is in turn connected to the slip idler and the left front wheel sprocket 23.

Figure 7:
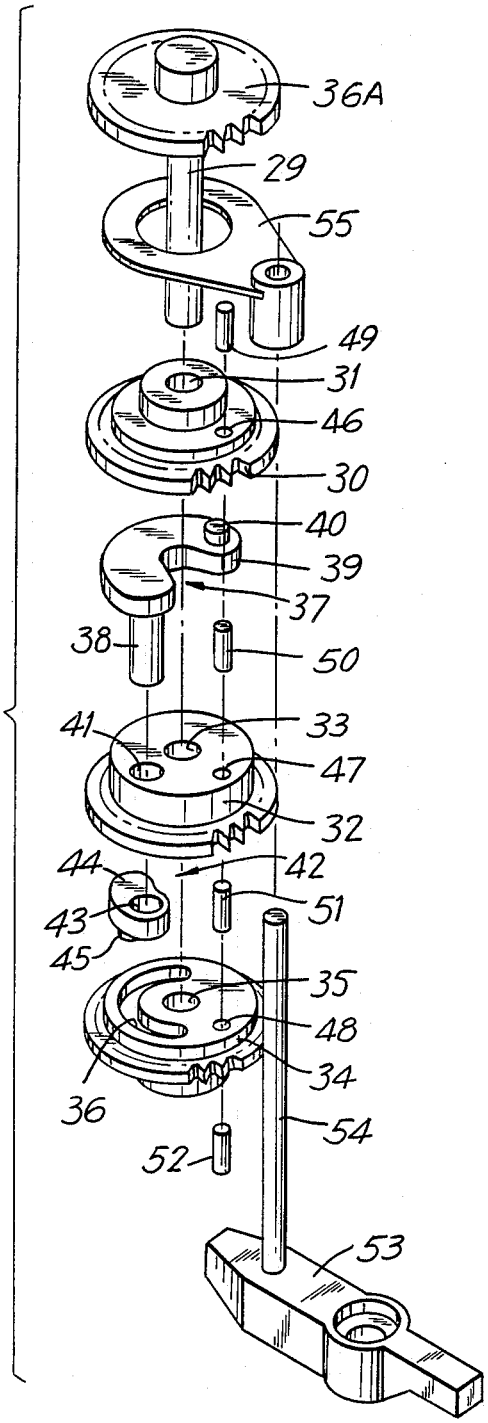
FIG. 7 is an elevational, exploded view of the dolly transmission of the present invention.

The rear wheels are driven off a common transmission pulley, to be described in detail when referring to FIG. 7 herein, by a common rear drive chain 24 to a pair of slip idlers 15 (one for each rear wheel), with the right rear side slip idler connected to right rear driven chain 25 and in turn the right rear wheel sprocket 26, for the right rear wheel, and the left rear slip idler connected to left rear driven chain 27, and left rear wheel sprocket 28, for the left rear wheel.

While the preferred embodiment of the present invention utilizes chain drive means to couple the dolly wheels, transmission and steering, other forms of drive means can be used, such as cogged belts and pulleys, in which case, pulleys are substituted for the chain sprockets shown and described herein.

FIG. 7 shows an exploded view of the transmission of the present invention, which utilizes a small number of parts—only four pulleys, a pair of levers and four pins—and provides a compact, lightweight design suitable for movie dollies. In the preferred embodiment, the four pulleys are toothed sprockets for receipt of the three wheel drive chains 18, 21 and 24 and the steering drive chain 14.

Transmission 13 has a transmission shaft 29, over which is fitted first sprocket 30 having a center bore 31 that allows rotation of the sprocket thereon. The second sprocket 32 is rigidly attached to shaft 29 through center bore 33 by known means such as welding, splines or keys. The third sprocket 34 is rotatably mounted on shaft 29 at center bore 35. The third sprocket 34 has a cam groove 36 therein, having a varying radius relative to the sprocket's rotational center.

In the preferred embodiment, the transmission 13 has a fourth pulley sprocket 36A, which is coupled to steering chain 14, the steering sprocket 12 and the control handle 8. Sprocket 36A is rigidly coupled to the transmission shaft 29. First sprocket 30 is coupled to the left front wheel drive chain 21, to rotate the left front wheel. The second sprocket 32 is coupled to the right front drive chain 18, to steer the right front wheel. Third sprocket 34 is coupled to the rear wheels drive chain 24, to steer both rear wheels.

The transmission 13 also has a first lever 37 having a shaft 38, a lever arm 39 and a lever arm pin 40 that rotatably mates into a bore on the bottom of the first sprocket 30, which is not shown, thereby coupling the lever to the sprocket. First lever shaft 38 passes through lever bore 41 in the second sprocket 32 and is rotatable in the bore. Thus, rotation of the second sprocket 32 circularly translates the first lever shaft 38, which in turn rotates the first sprocket 30.

Transmission second lever 42 has a bore 43 that rigidly receives first lever shaft 38 (e.g. by welding, splines or a key and keyway) so that levers 37 and 42 maintain constant relative positions. The second lever 42 also has a second lever arm 44 with a second lever pin 45 that slidably rides in the cam groove 36 in the third sprocket 34. The first and third sprockets 30 and 34 freely rotate relative to the second sprocket 32. By virtue of the offset, rigidly coupled transmission levers 37 and 42, rotation of shaft 29, by turning the control handle 8, rotates the second sprocket 32 at one angular velocity, but the lever arrangement causes the first sprocket 30 to rotate at a different angular velocity than the second sprocket. The difference in angular velocity rates is controlled by the profile of cam groove 36 on the third sprocket 34. Thus, as one skilled in the art can appreciate, varying the profile of cam groove 36 changes the relative orientation of the left front wheel (coupled to the first sprocket), and the right front wheel (coupled to the second sprocket) so that both front wheels can be properly oriented in the circular steering mode.

Figure 8:
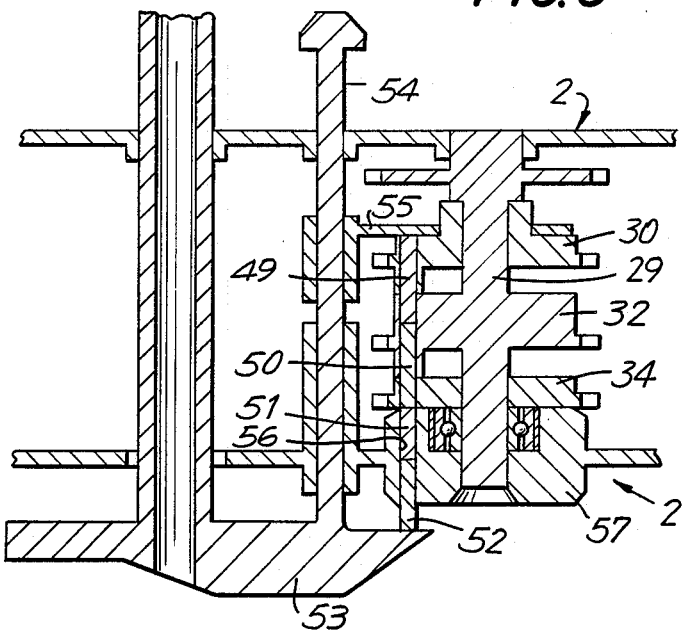
FIG. 8 is an elevational, cross-sectional view of the dolly transmission shifted into the crab steering mode.
Figure 9:
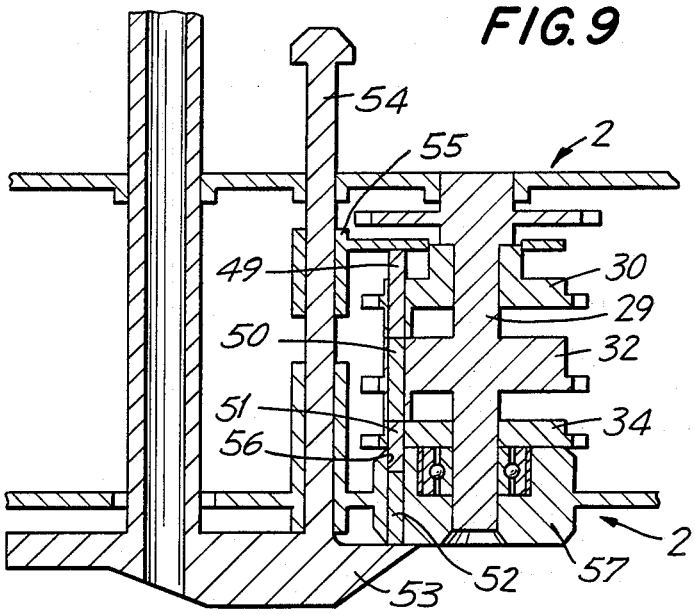
FIG. 9 is a cross-sectional view similar to FIG. 8, but with the transmission shifted into the circular steering mode.

Next, the shift actuation system is explained by reference to FIGS. 7–9. The first, second and third sprockets 30, 32, 34 each have pin bores 46, 47, 48, respectively, for reciprocable passage of transmission pins 49–52 therethrough. The transmission pins 49–52 are reciprocated by shift actuator 53 having a shift actuator shaft 54. Shift actuator 53 has a down position, shown in FIG. 8, when the dolly is in the crab steering mode and an up position, shown in FIG. 9, when the dolly is in the circular steering mode. A transmission stop plate 55 is slidable over shaft 54 and, in conjunction with the actuator 53, restrains the pins 49–52 therebetween.

The length of each transmission pin 49–52 is specifically chosen so that when the shift actuator is in the down, or crab steering mode, pin 49 is between sprockets 30 and 32, pin 50 is between sprockets 32 and 34 and pins 51 and 52 are in chassis bore 56 of chassis boss 57. Yet, the length of each pin 49–51 is also chosen so that when the shift actuator is in the up, or circular steering mode, pin 49 is only captured in sprocket 30, pin 50 is only captured in sprocket 32, pin 51 is captured between sprocket 34 and chassis boss 57 (thereby blocking rotation of sprocket 34) and pin 52 is captured within the chassis boss. One skilled in the art can appreciate that pins 51 and 52 can be combined into one single pin.

Thus, when the shift actuator 53 is in the down position or crab steering mode, the first, second and third sprockets 30, 32 and 34 are locked together for common rotation and the four wheels have parallel steering axes, as shown in FIG. 1. Rotating control handle 8 rotates steering sprocket 12 and drive chain 14, which rotates the fourth sprocket 36A and the first, second and third sprockets 30, 32 and 34 in unison, so that all four wheels are steered in parallel.

Figure 2:
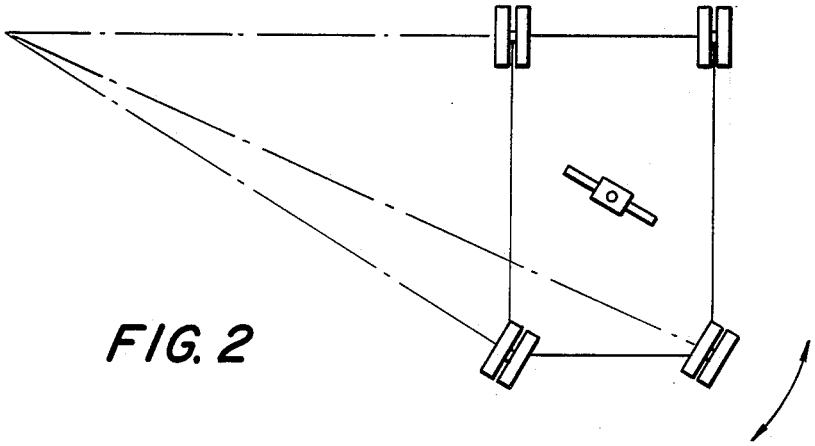
FIG. 2 shows schematically a movie dolly in the circular steering mode.

When the shift actuator is in the up, or circular steering mode, rotation of the third sprocket 34 is blocked, along with rotation of the dolly rear wheels as shown in FIG. 2, but the first and second sprockets 30 and 32 are rotatable relative to the blocked third sprocket 34, subject to the mutual relative rotational constraints posed by the second lever 42 riding in the cam groove 36, which orients the steering axes of both the dolly front wheels to a common point of intersection with the rear wheels steering axes. Rotation of the steering control handle 8 steers only the left and right front wheels.

Figure 10:
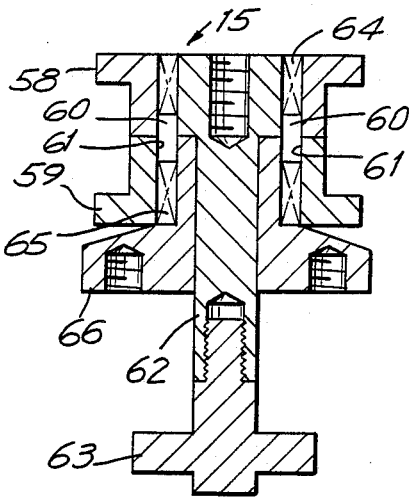
FIG. 10 is an axial, cross-sectional, elevational view of the slip idler of the present invention, when the neutral steering mode is not selected.
Figure 11:
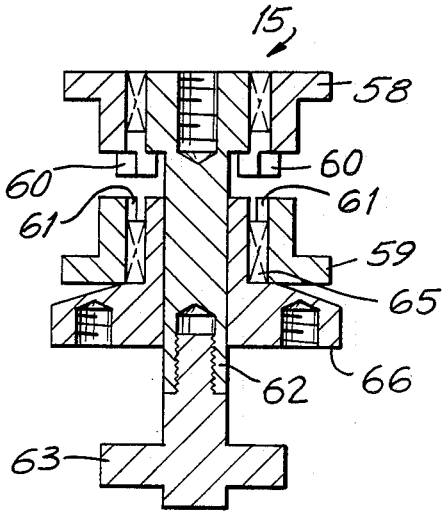
FIG. 11 is a front axial, cross-sectional, elevational view of the slip idler of the present invention, when it is set in the neutral steering mode.

The slip idler 15 of the present invention, used to select the neutral steering mode, is shown schematically in FIGS. 10 and 11. It comprises a pair of opposed first and second idler sprockets 58 and 59, respectively, reciprocable from a first neutral position proximate each other (FIG. 10) when the slip idler is not in the neutral steering mode to a second position distal each other (FIG. 11), when the slip idler is in the neutral steering mode.

The first sprocket 58 has at least one dog 60 projecting from it towards the second idler sprocket 59 and the dog is engageable in a recess 61 defined by the second idler sprocket, when the sprockets are proximate each other. The positions of the dog 60 and recess 61 can be transposed from one sprocket to the other. Desirably, the sprockets 58 and 59 have a plurality of dogs and recesses configured so that each dog is engageable in only one recess, so that the idler sprockets are orientable only in a single indexed position relative to each other. The sprockets 58 and 59 receive a drive chain and a driven chain so that rotational torque is transmitted from the drive chain to the driven chain when the slip idler is not in the neutral steering mode.

The slip idler 15 has an idler shaft 62 that has an idler shaft flange 63. The slip idler 15 has first bearing means, a roller bearing 64 that connects the shaft 62 to the first sprocket 58 and a second bearing means, a roller bearing 65 that connects the second sprocket 59 to a slip idler base 66, which base is connected to the chassis 2. The shaft 62 reciprocates relative to the base 66.

Figure 12:
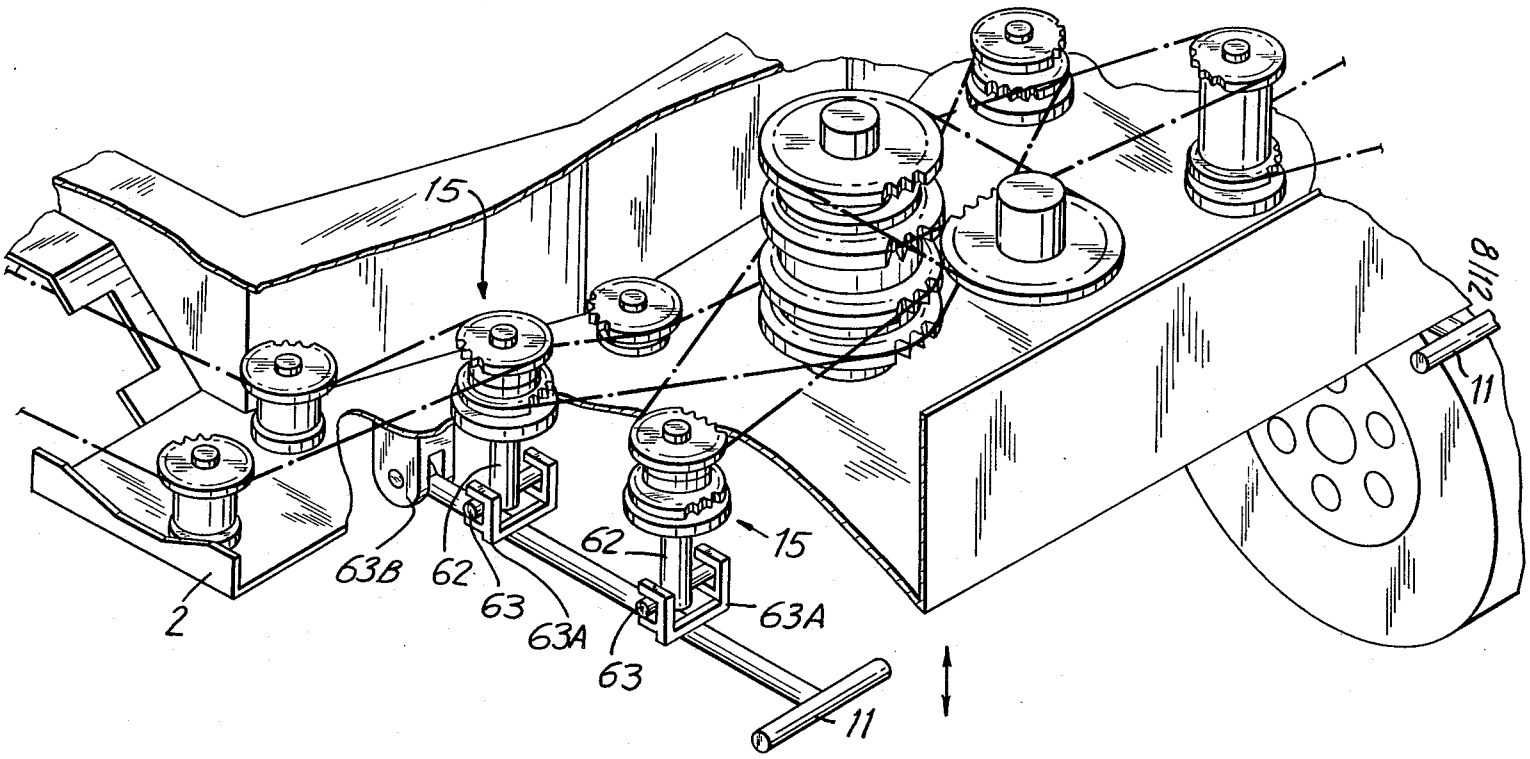
FIG. 12 is a front, partial cutaway, perspective view of the slip idler gear actuating lever assembly.

As shown in FIG. 12, the slip idler shaft flanges 63 are captured to within idler forks 63A that are connected to the slip idler actuating lever 11 and the lever is pivotably attached to the chassis 2 by lever flanges 63B. In operation, upwardly reciprocating lever 11 shifts the wheels 7 into the neutral steering mode, by separating the opposed sprockets 58 and 59 and rotational torque is not transmitted from wheel drive chains to the driven chains. Thus, rotation of the steering control handle 8 only rotates the drive chains 18, 21 and 24, but not the corresponding driven chains 19, 22, 25 and 27.

Downwardly reciprocating the slip idler lever 11 urges the sprockets 58 and 59 toward each other, to enable the dogs 60 to mate in the recesses 61. After downwardly reciprocating the slip idler lever 11, rotation of the control handle 8 rotates idler sprocket 58 relative to sprocket 59 until the dogs 60 and recesses 61 index relative to each other and mate to allow rotational torque transmittal between the sprockets. As shown in the preferred embodiment, slip idler actuating lever 11 is a means for simultaneously connecting and disconnecting in unison two slip idlers 15.

While FIG. 12 only shows a lever for actuating the right side wheels slip idlers, an identical lever assembly is utilized for the left side wheels. If desired, both the right and left wheels levers can be combined into a common, centrally located handle. As a cost-saving measure, the lever assemblies 11 can be deleted, but selecting the neutral steering mode would require turning over the dolly 1 in order to reciprocate the slip idler shafts 62.

Figure 13:
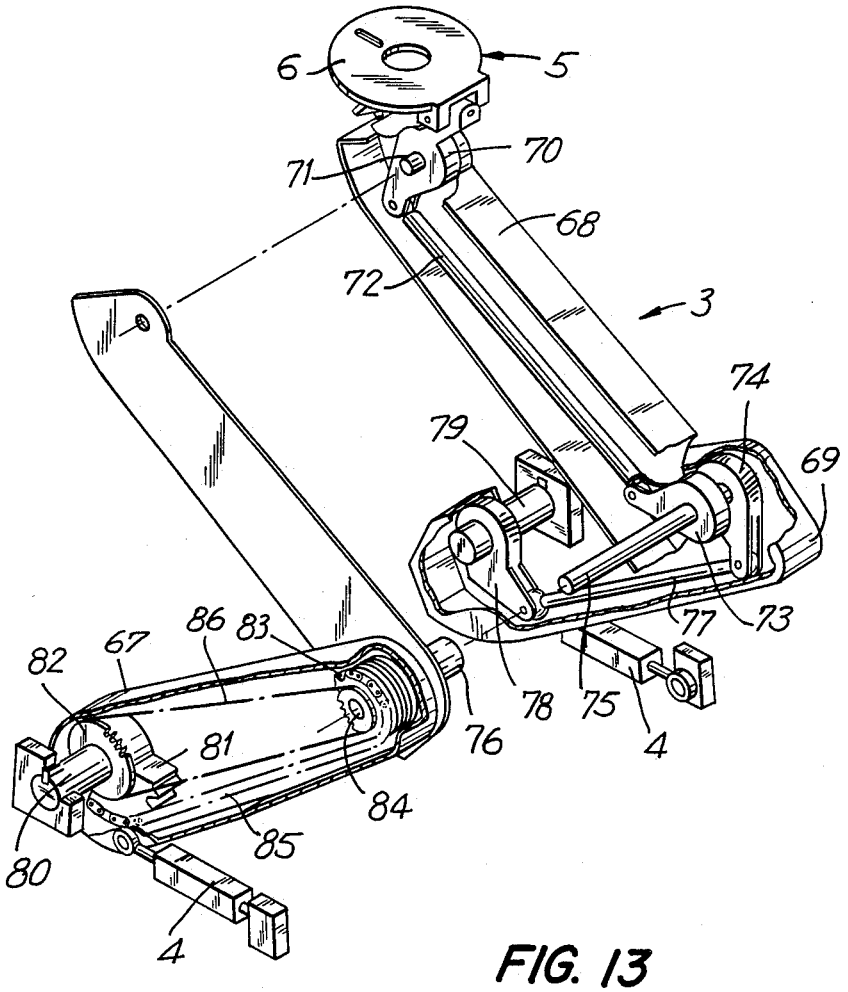
FIG. 13 is a front, partially exploded, perspective view of the lifting arm of the present invention.

FIG. 13 shows an exploded view of the lifting arm 3 of FIGS. 4 and 5, which is a scissor-type arms the operation of which will be explained after setting forth the structural relationship of the arm components. Arm 3 has three main component groups: a right arm housing 67, a center arm housing 68 and a left arm housing 69. The center arm housing 68 contains a crank 70 that is connected to levelling head 5 and rotates about shaft 71 running through the housing on journals. Another arm of crank 70 is rotatably connected to the center levelling arm rod 72 which in turn rotatably connects to an arm of crank 73. Crank 73 is rigidly connected to crank 74 by shaft 75, which in turn rides in journaled shaft 76, but shaft 76 is rigidly mounted in center arm housing 68.

Shaft 75 may be extended on either side to accommodate a bracket for a cameraman's seat, which is not shown. Crank 74 rotatably connects to levelling rod 77, which is in turn rotatably connected to crank 78. Crank 78 is rigidly connected to shaft 79 that rigidly connects to the chassis, 2 but which is rotatably connected to housing 69. Shaft 80 is also rigidly attached to chassis, 2 but also rotatably connected to housing 67. Rigidly attached to shaft 80 are sector-shaped primary sprocket 81 and secondary sprocket 82, which may be either sector- or circular-shaped. Sector-shaped primary sprocket 83 and the secondary sprocket 84 are rigidly connected to shaft 76, with the secondary sprocket 84 having either a circular or sector shape.

The primary sprockets 81 and 83 are connected by primary chain 85, which rotates shaft 75 and the secondary sprockets 82 and 84 are connected by secondary chain 86, which takes slack out of the primary chain and prevents manual lifting of the arms.

Primary sprocket 81 and secondary sprocket 82 have twice the diameter of corresponding primary sprocket 83 and secondary sprocket 84, to insure that shaft 76 counter-rotates at twice the angular velocity of the left and right arm housings 67 and 69.

As those skilled in the art can appreciate, the object of a scissor-type lifting arm, such as that described herein, is to allow vertical translation of the levelling head 5 without changing orientation of the platform 6 relative to the ground upon which the dolly is situated. In the lifting arm 3, vertical translation is effected by the right, center and left arm housings, 67, 68 and 69, in conjunction with the sprockets and chains contained in the right housing and the hydraulic cylinders 4. The cranks and levelling rods contained in the center and left arm housing 68 and 69 maintain a constant orientation of the levelling head platform 6 relative to the ground.

To lift the arm 3, the hydraulic cylinders 4 are pressurized, thereby rotating the right and left arm housings 67 and 69 counterclockwise and the primary sprockets 81 and 83 and primary chain 85 counter-rotate the center arm housing 68 in a clockwise direction at twice the angular velocity of the left and right arm housings.

In contrast to the arm housings 67, 68 and 69, the shafts 71, 75 and 79, onto which the corresponding cranks 70, 73, 74 and 78 are rigidly attached, cannot change their angular orientation relative to the ground during arm housing rotation, because those shafts are rotatable relative to the housings. Shaft 79 is rigidly attached to the chassis 2 and by means of crank 78, levelling rod 77 and crank 74, and prevents angular rotation of shaft 75. Since shaft 75 cannot rotate, crank 73 and levelling rod 72 prevent angular rotation of crank 70, onto which the levelling head platform 6 is mounted. Accordingly, the levelling head platform 6 maintains the same angular orientation of shaft 79, which is rigidly attached to the chassis 2.

Figure 14:
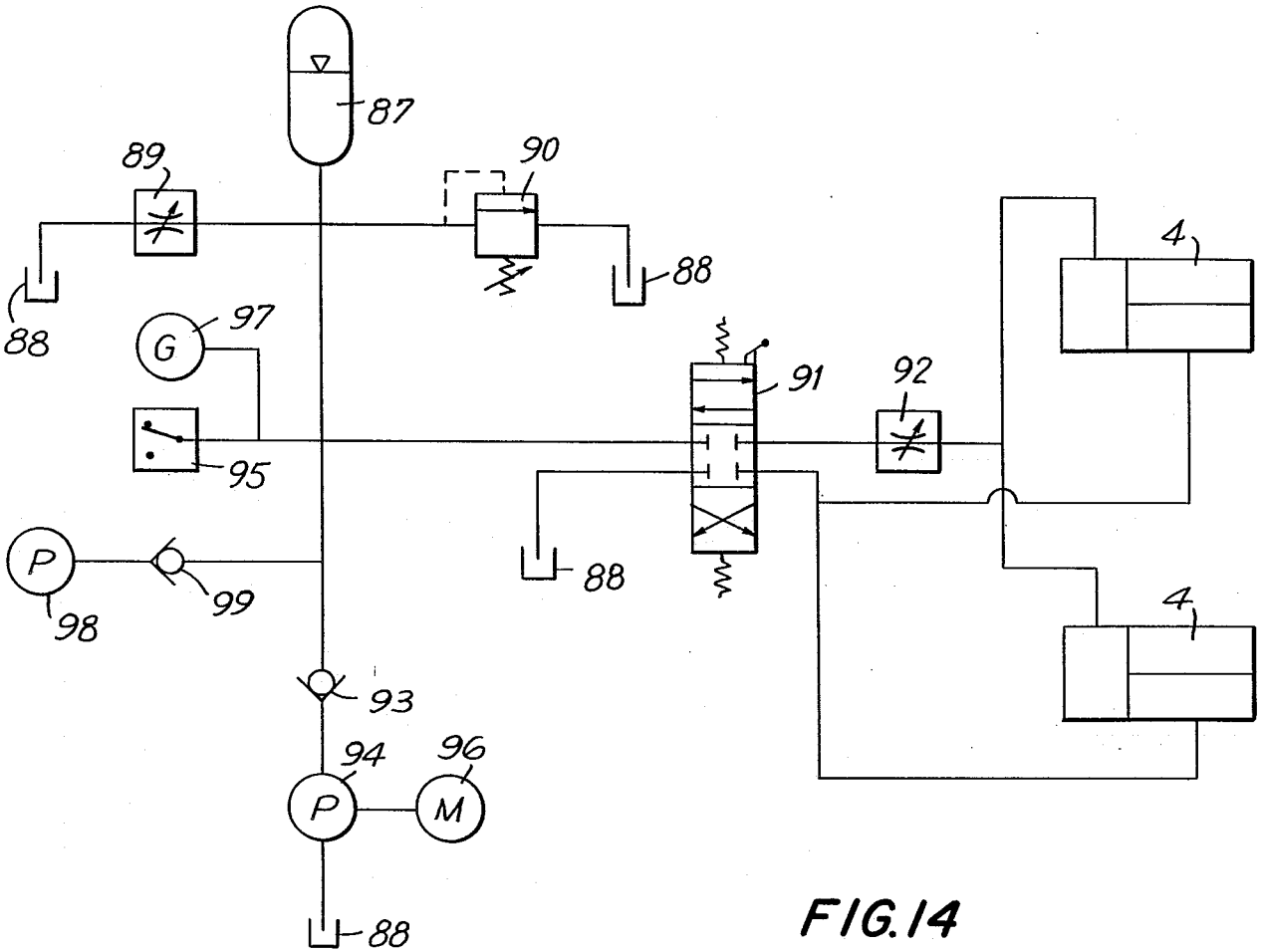
FIG. 14 is a schematic diagram of the lifting arm hydraulic system, which provides means for lifting the lifting arm.

The means for lifting the lifting arm 3 is the hydraulic system shown in FIG. 14. The system works on the principle of a high pressure hydraulic accumulator 87 supplying the hydraulic cylinders 4 with pressurized fluid, that is in turn vented to an ambient pressure common reservoir 88. All components of the hydraulic system are of known construction. It is desirable, but not required, for both the accumulator 87 and the reservoir 88 to be mounted in the chassis for a more compact design.

The accumulator 87 connects to a bleed valve 89 for selective pressure discharging thereof and to a variable pressure relief valve 90 to prevent explosive overpressurization of the accumulator. The accumulator 87 is also connected in parallel to a hydraulic system actuator, which is preferably a manually-operated, spring-centered directional control valve 91 that is connected to a needle valve 92, for setting the desired arm raising and lowering speed, and the needle valve is in turn connected to the hydraulic cylinders 4. To relieve pressure in the hydraulic cylinders 4, they are connected back to the control valve 91 and in turn to the reservoir 88. Rocking an actuator lever on the control valve 91 in one direction routes more pressurized fluid to the cylinders 4 and rocking the valve lever in another direction allows pressurized fluid to escape the cylinders to the reservoir 88.

To charge the accumulator 87, it is connected by ball valve 93 to motorized pump 94, which pumps hydraulic fluid from the reservoir 88 to the accumulator 87. For safety, an electrical cutoff switch 95 is connected in parallel to the accumulator 87 and shuts off the pump motor 96 when a preset system pressure is attained. Gauge 97 allows reading of the system pressure. A manual pump 98 is selectively connectable to the hydraulic system by ball valve 99, in case of electrical motor failure or in locations without electricity. A common ball valve may be used for either the motorized pump 94 or the manual pump 98 and the operator would selectively connect the desired pump to the valve.

To lift the arm 3, the control valve 91 lever is rocked in the pressurization direction to add pressurized fluid to the hydraulic cylinders 4, which retracts the cylinder pistons into the cylinders and rotates the right and left arm housings 67 and 69 in a counterclockwise direction, shown in the right perspective view of FIG. 13. Rocking the control valve 91 lever in the depressurization direction allows pressurized fluid to escape the cylinders 4 and allows the arm housings 67 and 69 to pull the cylinders 4 pistons out of the cylinders, which rotates the arm housings in a clockwise direction, shown in the right perspective view.

Figure 15:
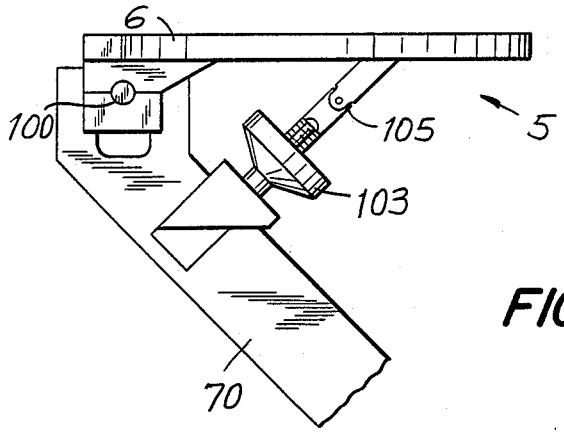
FIG. 15 is a elevational view of the levelling head of the present invention.
Figure 16:
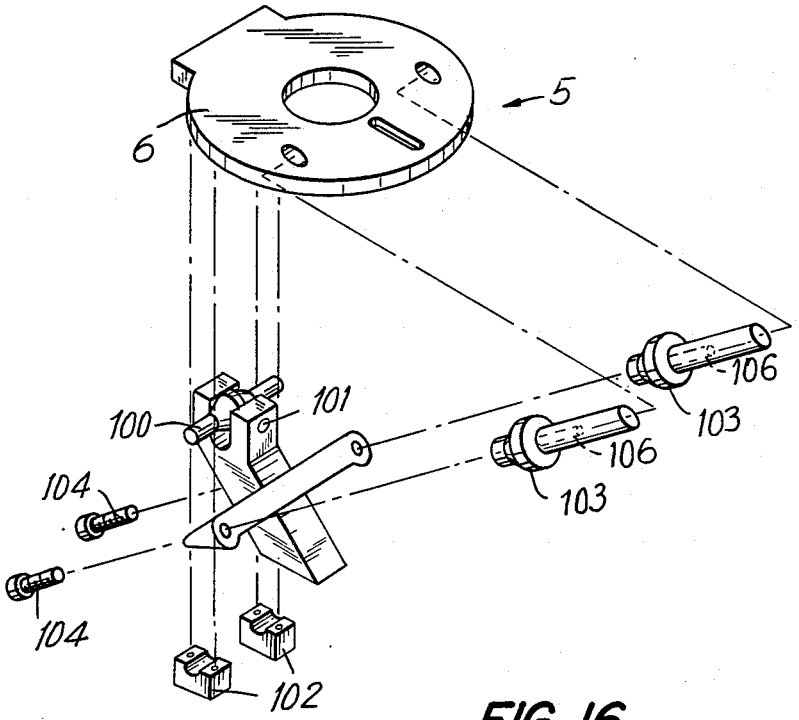
FIG. 16 is an exploded view of the levelling head of the present invention.

FIGS. 15 and 16 show the dolly levelling head 5 of the present invention. The levelling head 5 has a platform 6 with pivot means for coupling the platform to the lifting arm crank 70, such as the universal joint 100 shown. Universal joint 100 is attached to crank 70 by pin 101 and the joint is captured by saddle blocks 102, which bolt to the platform 6. An alternative pivoting means is a ball and socket joint, not shown, or any other suitable device which allows at least two degrees of rotational movement freedom. A pair of reciprocable adjuster means is each coupled to the crank 70 and is shown in FIG. 15 as a female threaded screw adjuster wheel 103 which mates with male threaded member bolt 104.

As a desirable, but not required feature, the adjusting means has a pivoting means to insure proper alignment with the platform 6. As shown in FIG. 15, the adjusting means pivoting means is a universal joint and in FIG. 16, the pivoting means is a ball and socket joint 106.

Rotating both adjuster wheels 103 at the same rate changes the levelling head 5 pitch orientation and rotating only one or the other adjuster wheel changes the levelling head roll orientation. Changing the relative rotation rate of both adjuster wheels 103 simultaneously changes both the pitch and roll orientation of the levelling head 5.

Figure 17:
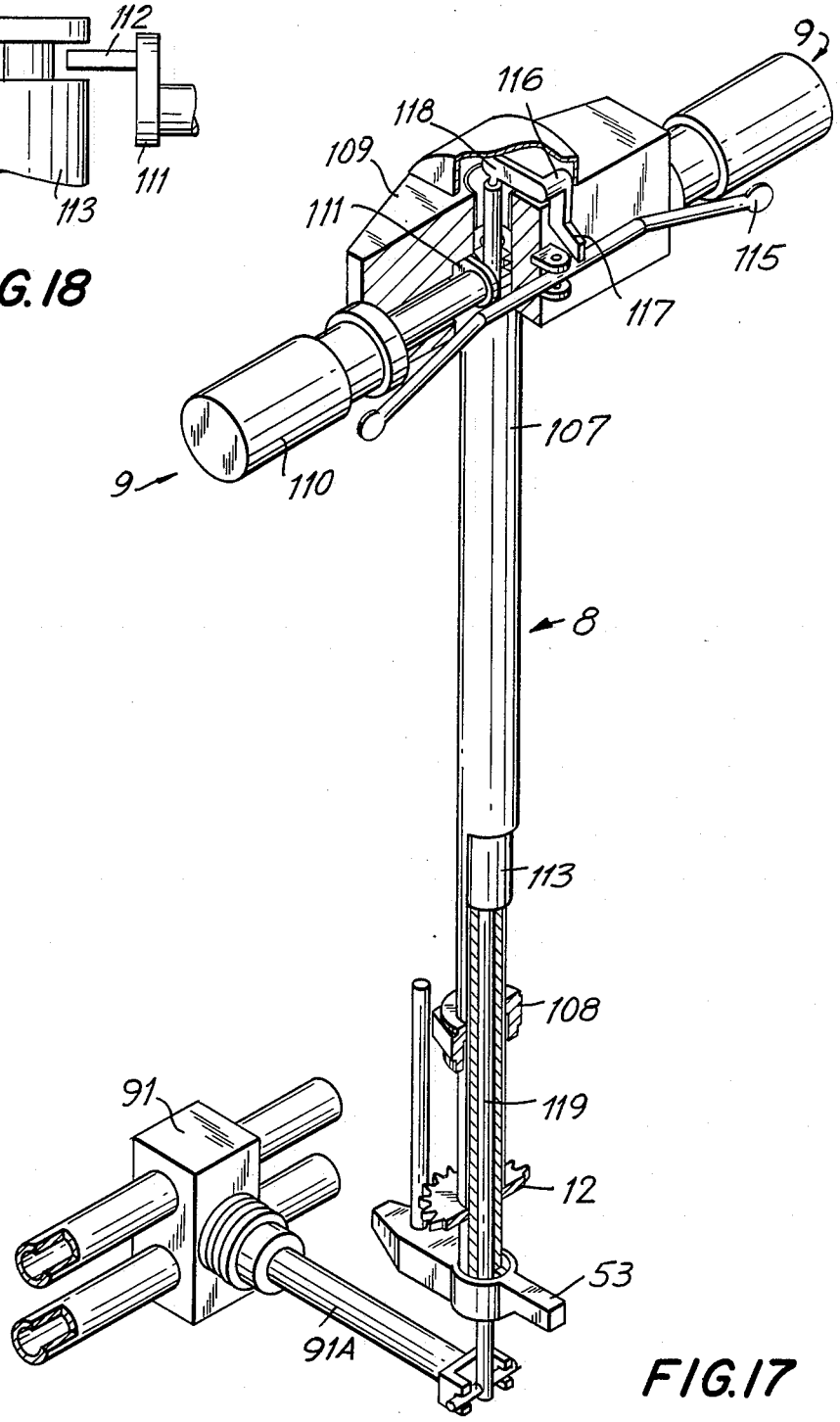
FIG. 17 is a front perspective, elevational, partial cut-away view of the control handle of the present invention.

As shown in FIG. 5, the compact design of the levelling head 5, in conjunction with the lifting arm 3, allows the head to be virtually flush with the top of chassis 2 and allows the lowest possible movie shooting angles, which advantageously increases the dolly's operational flexibility for enhanced filming creativity. FIG. 17 shows in detail the control handle 8 of the present invention. Handle 8 has a rotatable steering shaft 107 which is shown as tubular, and which is connected to the steering sprocket 12. As previously described, sprocket 12 translates drive chain 14, which is connected to transmission sprocket 36A. Rotation of the transmission sprocket 36A rotates the remainder of the chain-driven wheel steering means and turns the steerable wheels 7, when the slip idlers 15 are not in the neutral, disconnected mode. Bearing 108 is connected to the chassis 2 and supports the steering shaft 107.

Figure 18:
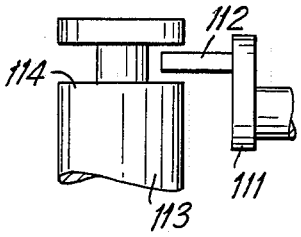
FIG. 18 is a fragmentary, rear-elevational, perspective view of a portion of the control handle of FIG. 17, showing the middle tube coupled to the grip portion eccentric crank.

The control handle 8 has a body onto which is attached at least one, but preferably two grip portions 9, at least one of which is shown as the left-most one (110) in FIG. 16. Attached to the grip portion 110 is an eccentric crank 111 having an eccentrically offset pin member 112, that is coupled to a middle tube 113, nested within the shaft 107, by riding in a groove 114 on the upper end of the middle tube, as shown in FIG. 18. The bottom end of the middle tube 113 is connected to the shift actuator 53. Twisting the grip portion 110 rotates the grip portion crank 111 and in turn reciprocates the middle tube 113 and the shift actuator 53. As shown in conjunction with FIGS. 8 and 9, twisting the grip portion 100 in either direction actuates the transmission into either the crab or circular steering mode.

The control handle 8 also has lever means 115 coupled to the control handle body 109, a bell crank 116 having a rotational axis coupled to the body and first and second arms 117, 118, with the first arm coupled to the lever 115 and the second arm coupled to a reciprocable inner member 119 nested within the middle tube 113. The inner member 119 is coupled to the hydraulic actuator lever 91A. Rocking the lever means 115 reciprocates the inner member 119 and in turn rocks the hydraulic actuator lever 91A to route more pressurized fluid to the hydraulic cylinders 4 or to let pressurized fluid escape from the cylinders, depending on which position the operator rocks the lever means 115.

Although the invention has been described with reference to the preferred embodiment, it should be apparent to those skilled in the art that various modifications and improvements may be made in and to the dolly, without departing from the spirit and scope of the invention.

What is claimed is:

1. A movie equipment dolly comprising:

(a) a chassis;

(b) a lifting arm connected to said chassis;

(c) means for lifting said lifting arm upon actuation thereof, connected to said lifting arm;

(d) at least one steerable wheel connected to said chassis for moving said dolly;

(e) a transmission connected to said wheel for orienting said wheel into selectable steering modes upon actuation thereof; and (f) a control handle having:

(1) a rotatable steering shaft connected to said wheel for steering said wheel, (2) at least one moveable grip portion connected to said steering shaft and said transmission for rotating said shaft and for actuating said transmission, and (3) lever means connected to said steering shaft and said means for lifting, for actuating said means for lifting.

2. The movie equipment dolly as recited in claim 1, wherein said steering shaft has a sprocket mounted on an exterior surface thereof, and that is connected to said transmission and said steerable wheel by chain drive means.

3. The movie equipment dolly as recited in claim 1, wherein said grip portion is twistable and connected to said transmission by an eccentric grip portion crank attached to said grip portion, a reciprocable middle tube connected to an eccentrically offset member on said grip portion crank, and a shift actuator connected to said middle tube and said transmission, so that twisting said grip portion rotates said grip portion crank and in turn reciprocates said middle tube, moving said shift actuator and in turn actuating said transmission.

4. The movie equipment dolly as recited in claim 1, wherein said lever means is connected to said means for lifting by a bell crank having a rotational axis connected to said control handle and first and second arms projecting therefrom, said first arm being connected to said lever and said second arm being connected to a reciprocable inner member, and said inner member being connected to said means for lifting said lifting arm.

5. A movie equipment dolly comprising:

(a) a chassis;

(b) a lifting arm connected to said chassis;

(c) a hydraulic system for lifting said lifting arm upon actuation thereof, connected to said lifting arm, and having a hydraulic actuator;

(d) at least one steerable wheel connected to said chassis for moving said dolly;

(e) a transmission connected to said wheel for orienting said wheel in selected steering modes, upon actuation thereof; and (f) a control handle having:

(1) a rotatable steering tube connected to said wheel and said transmission by drive means, for steering said wheel, (2) at least one twistable grip portion connected to said steering tube, for rotating said steering tube, eccentric means connected to said grip portion, a reciprocable tube nested within said steering tube, and a shift actuator connected to said tube and said transmission, such that twisting said grip portion rotates said eccentric means and in turn reciprocates said tube, recipricating said shift actuator and in turn actuating said transmission, and (3) lever means connected to said control handle, a crank having a rotational axis connected to said control handle and first and second arms projecting therefrom, said first arm being connected to said lever means and said second arm being connected to a reciprocal inner member nested in said tube, said inner member being connected to said hydraulic actuator;

whereby said steering, steering mode selection and arm lifting operations are all effectuable on a common control handle by a dolly operator without the need for the operator to remove his hands from said control handle to effectuate any of such operations.

6. A movie equipment dolly comprising:

(a) a chassis;

(b) a lifting arm connected to said chassis; and (c) a levelling head connected to said lifting arm having:

(1) a platform for mounting of movie equipment thereon, (2) pivoting means having at least two degrees of rotational freedom, coupled to said lifting arm and said platform, (3) a pair of reciprocable adjusters, each coupled to said lifting arm and said platform for simultaneous orientation of the levelling head roll and pitch axes having:

(i) a male threaded portion, (ii) a female threaded portion connectable to said male threaded portion, (iii) an adjuster wheel for rotation of said male and female threaded portions relative to each other, and (iv) a ball and socket joint for alignment of said platform relative to said lifting arm.

7. A movie equipment dolly comprising:

(a) a chassis;

(b) a lifting arm connected to said chassis; and (c) a levelling head connected to said lifting arm having:

(1) a platform for mounting of movie equipment thereon, (2) pivoting means having at least two degrees of rotational freedom, coupled to said lifting arm and said platform, (3) a pair of reciprocable adjusters, each coupled to said lifting arm and said platform for simultaneous orientation of the levelling head roll and pitch axes having:

(i) a male threaded portion, (ii) a female threaded portion connectable to said male threaded portion, (iii) an adjuster wheel for rotation of said male and female threaded portions relative to each other, and (iv) a universal joint for alignment of said platform relative to said lifting arm.

* * * * *